United States Patent [19]

Rohs

[11] 3,951,567

[45] Apr. 20, 1976

[54] SIDE CHANNEL COMPRESSOR

[76] Inventor: Ulrich Rohs, Roonstr. 11, 516 Duren, Germany

[22] Filed: Nov. 6, 1974

[21] Appl. No.: 521,456

Related U.S. Application Data

[63] Continuation-in-part of Ser. No. 313,478, Dec. 8, 1972, abandoned.

[30] Foreign Application Priority Data

Dec. 18, 1971 Germany ..... 2163011

[52] U.S. Cl. ..... 415/119; 415/213 T

[51] Int. Cl.[2] ..... F01D 5/10

[58] Field of Search ..... 415/53 T, 198 T, 199 T, 415/213 T, 119, 106

[56] References Cited

UNITED STATES PATENTS

| | | | |
|---|---|---|---|
| 1,689,579 | 10/1928 | Burks | 415/198 T |
| 1,973,669 | 9/1934 | Spoor | 415/198 |
| 2,217,211 | 10/1940 | Brady | 415/53 T |
| 2,659,312 | 11/1953 | Wahle | 415/106 |
| 3,252,421 | 5/1966 | Luhmann | 415/213 T |
| 3,556,680 | 1/1971 | Leutwyler et al. | 415/119 |

FOREIGN PATENTS OR APPLICATIONS

| | | | |
|---|---|---|---|
| 165,330 | 11/1905 | Germany | 415/119 |
| 581,808 | 8/1933 | Germany | 415/53 T |
| 676,527 | 6/1939 | Germany | 415/106 |
| 1,110,567 | 10/1955 | France | 415/213 T |
| 322,276 | 12/1935 | Italy | 415/213 T |

*Primary Examiner*—Henry F. Raduazo
*Attorney, Agent, or Firm*—Diller, Brown, Ramik & Wight

[57] ABSTRACT

This disclosure relates to a side channel compressor comprising a housing defining a fluid conveying chamber, the fluid conveying chamber being of a curved configuration, a compressor wheel, means mounting the compressor wheel for rotation about an axis, fluid inlet and fluid outlet ports in fluid communication with the fluid conveying chamber, the compressor wheel having a plurality of blades which during the rotation of the compressor wheel move fluid along the chamber in a direction from the inlet port toward the outlet port, each blade being disposed generally radially relative to the axis of rotation of the compressor wheel, each blade having radially innermost and outermost blade portions with the latter being more remote from the axis than the former, and the innermost and outermost blade portions being inclined relative to the compressor wheel axis and inclined in the direction of fluid flow along the chamber with the angle of the innermost blade portions to a plane normal to the axis being greater than the angle of the outermost blade portions to a like plane normal to the axis whereby optimum flow conditions of fluid through the chamber is achieved.

12 Claims, 9 Drawing Figures

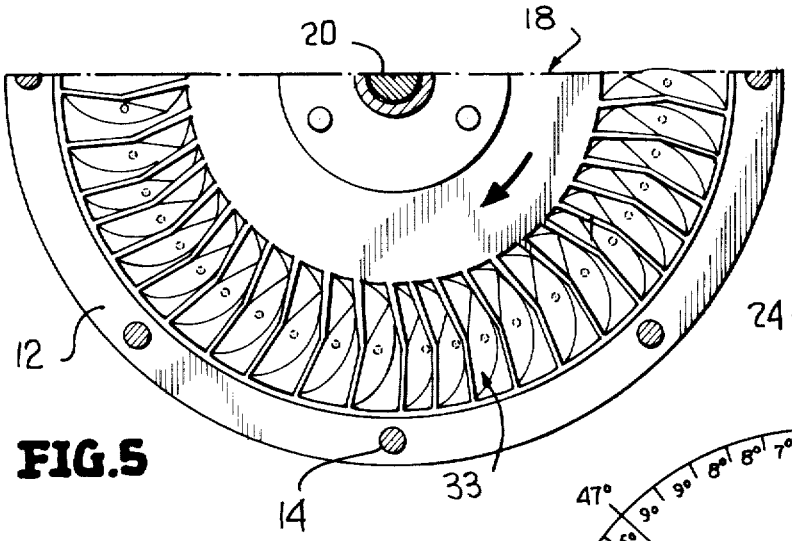
FIG.5
FIG.7
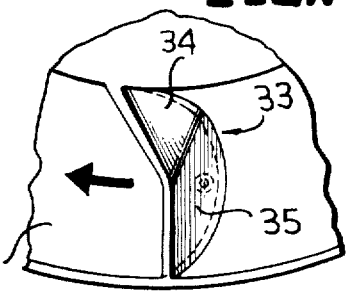
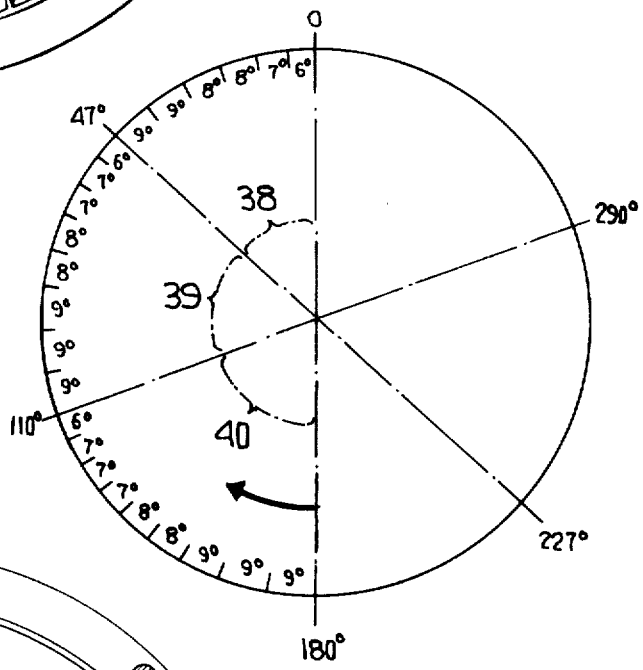
FIG.9
FIG.6
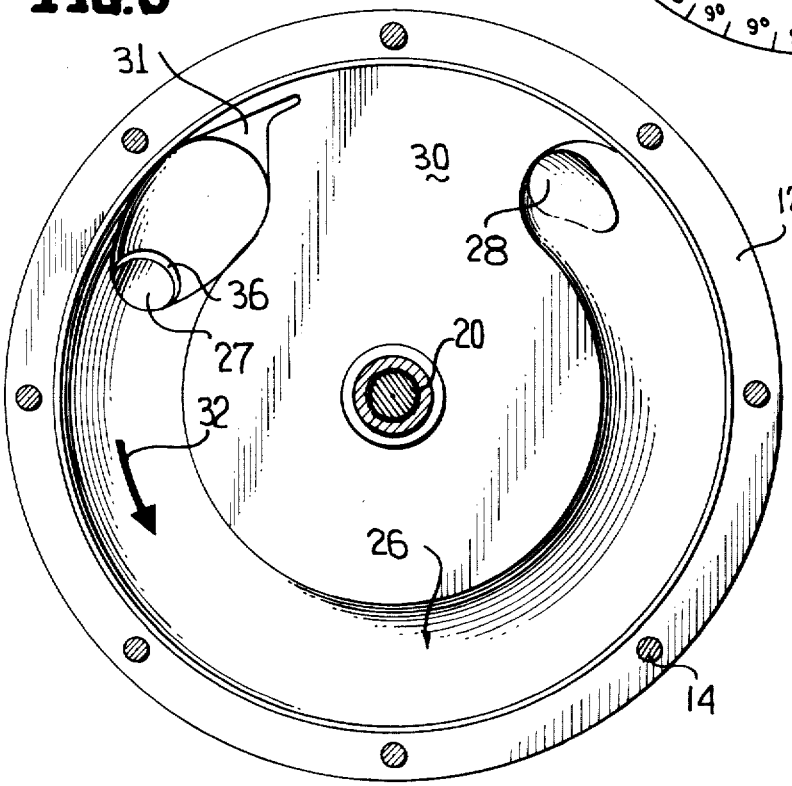
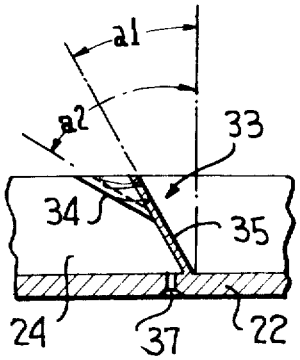
FIG.8

SIDE CHANNEL COMPRESSOR

The present disclosure is a continuation-in-part of application Ser. No. 313,478 entitled Side Channel Compressor, filed Dec. 8, 1972 now abandoned.

The present invention relates to a side channel compressor having a compressor wheel, the blades of which rotate in a conveying chamber having a curved or torus configuration.

BACKGROUND OF THE INVENTION

A side channel pump or compressor of the type to which this invention is directed is disclosed in Germany published Application No. 1-921945. As is explained in the introduction to the latter application, side channel compressors with axial flow are heretofore preferred because the flow characteristics thereof could be calculated more easily. Flow characteristics of side channel compressors with radial blades cannot be calculated according to prevailing opinion so that one is forced to use empirical data for the determination of the connection between the volume through-put and pressure because of the complexed flow.

SUMMARY OF THE INVENTION

The present invention is based on the objective of creating a simple, sturdy construction of a side channel compressor producing radial currents, the blade position of which will guaranty the best possible conditions of volume flow or through-put and pressure, as well as a smooth entry of flow into the wreath of the blades.

The invention initiates from a method of calculation of the blade angles that have been found which in the present case is of interest only in regard to optimum range.

The invention resides in the fact that the blades are disposed generally radially and bent forward such that the outside angles of attack of the blades are smaller than the inside angles of attack. At the same time, the outside angles of attack for practical purposes are smaller than 45°, preferably 30° plus or minus 15°, and the inside angles of attack are larger than 45°, preferably 60° plus or minus 15°. Within these ranges optimum flow conditions are achieved.

A further essential characteristic of the invention lies in the fact that the inlet for the conveying medium is arranged opposite to the direction of flow or the direction of rotation of the compressor wheel. By this construction smooth entry of the flow medium into the channel or wreath of the blades is achieved.

A further advantageous characteristic of the invention consists in the fact that the angle between the inlet channel and the plane of rotation of the compressor wheel is smaller than or equals 45° on the inside half of the torus whereby the inlet channel is developed effectively as a convergent nozzle or orifice.

In order to avoid undesirable noise at higher revolutions per minute it has further been provided that the distribution of the blades on the compressor wheel is non-uniformed in such a way that groups of blades are distributed over various sector angles which are mutually non-divisible, and that the distribution of the blades within a group of blades is variable. At the same time it is effective if the interval between the blades within each group of blades increases oppositely to the rotational direction of the compressor wheel and if each half of the wheel has its diametric complement of each blade.

Susprisingly, it turns out that as a result of the latter the resident effect is reduced and virtually eliminated.

In order to avoid a sudden reduction of pressure on an interruptor surface between the inlet and outlet channels relief recess means have been provided adjacent the inlet channel, the length of which corresponds to at least that of the largest chamber between adjacent blades.

With the above and other objects in view that will hereinafter appear, the nature of the invention will be more clearly understood by reference to the following detailed description, the appended claims and the several views illustrated in the accompanying drawings:

IN THE DRAWINGS

FIG. 5 is a fragmentary sectional view taken generally along line 5—5 of FIG. 3, and illustrates the plurality of blades of the compressor wheel including innermost and outermost blade portions at different angles of attack.

FIG. 6 is a sectional view taken generally along line 6—6 of FIG. 3, and illustrates recess means formed in an interruptor surface between the inlet and outlet ports of the housing.

FIG. 7 is a fragmentary view of one of the blades of FIG. 5, and more clearly illustrates the construction thereof and the association of the blade with an aperture formed in a bottom or spanning wall of the compressor wheel.

FIG. 8 is a sectional view through anyone of the blades, and illustrates the difference in the inside and outside angles of attack thereof.

FIG. 9 is a diagrammatic presentation of the division of the blades along the periphery of the compressor wheel.

Figure 1:
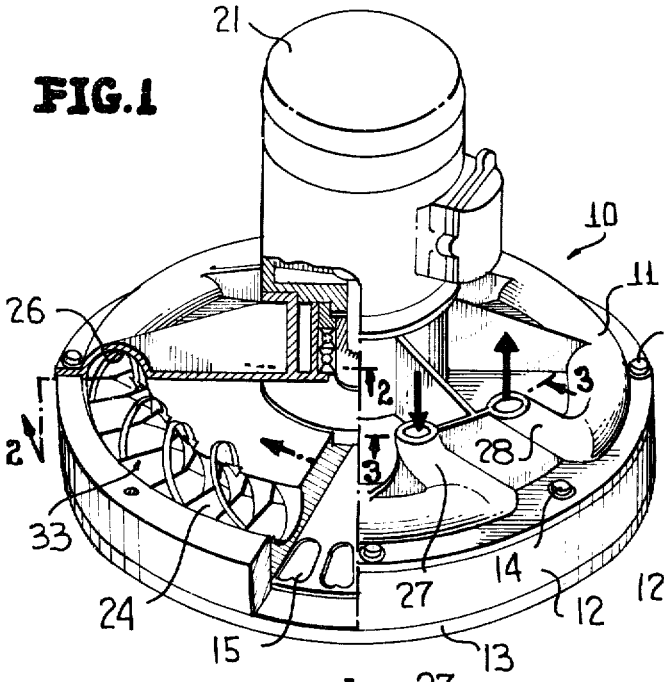
FIG. 1 is a perspective view of a side channel compressor constructed in accordance with this invention with several parts broken away for clarity, and illustrates the manner in which fluid flow takes place during the rotation of a compressor wheel.
Figure 4:
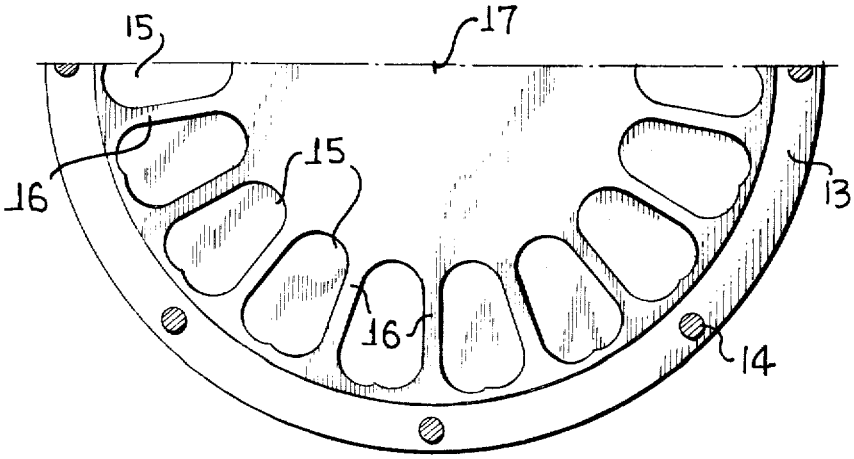
FIG. 4 is a sectional view taken generally along line 4—4 of FIG. 3, and illustrates a plurality of peripherally spaced recesses formed in a bottom plate of the compressor housing which are aligned with apertures formed in the compressor wheel between pairs of blades thereof.

Reference is first made to FIG. 1 in which is illustrated a side channel compressor 10 of a construction in accordance with the invention which resembles a Fottinger-coupling. The compressor 10 includes an upper housing body 11, an annular ring 12, and a lower plate 13 which are secured to each other by a plurality of bolts 14. The bolts 14 pass through supple apertures (unnumbered) in the elements 11, 12 and 13, and the latter apertures of the plate 13 are threaded in the manner best illustrated in FIG. 2. The plate 13, as is best illustrated in FIG. 4, includes a plurality of recess means or recesses 15 which are formed by grinding the plate 13 or casting the same to include the recesses 15 therein. Adjoining pairs of recesses 15 are spaced from each other by a bridging wall 16 and the recesses are disposed about a common center which is the axis 17 of rotation of a compressor wheel 18 secured in a conventional manner to a shaft 20 (FIG. 2) of a motor (unnumbered) carried in a housing portion 21 of the housing element 11. The motor is preferably electrically operated and may be provided with supple controls for constant or variable speed.

Figure 2:
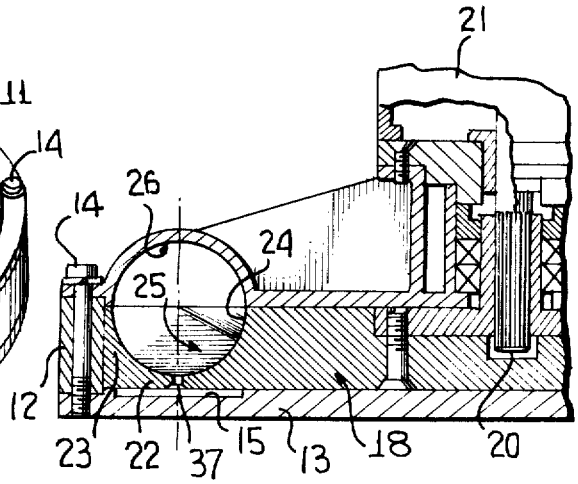
FIG. 2 is an enlarged fragmentary sectional view taken generally along line 2—2 of FIG. 1, and more clearly illustrates the compressor housing and the rotor thereof.

The compressor wheel or rotor 18 is a plate of steel or like material having a bottom wall 22, an outermost wall or surface 23 and an innermost wall or surface 24 (FIG. 2). The wall or surface 22 spans and in effect forms a continuation of the walls or surfaces 23, 24 to define a generally arcuate or semi-cylindrical trough or channel 25 which circles the entire periphery of the compressor wheel 18. The channel 25 opposes a like semi-circular channel 26 formed by an appropriate curvature of the housing portion 11 which further includes an inlet port 27 and an outlet port 28. The ports 27, 28 are bridged by an interruptor surface 30 (FIG. 6). The interruptor surface 30 is provided with a recess 31 (FIG. 6) which tapers in a winding direction in the same direction of rotation of the compressor wheel 18, the latter direction being indicated by the headed arrow 32 of FIG. 6. The length of the recess 31 as measured in the direction of rotation 32 of the rotor wheel or compressor wheel 18 is at least as great as the maximum spacing between adjacent blades 33 of the compressor wheel 18.

Figure 3:
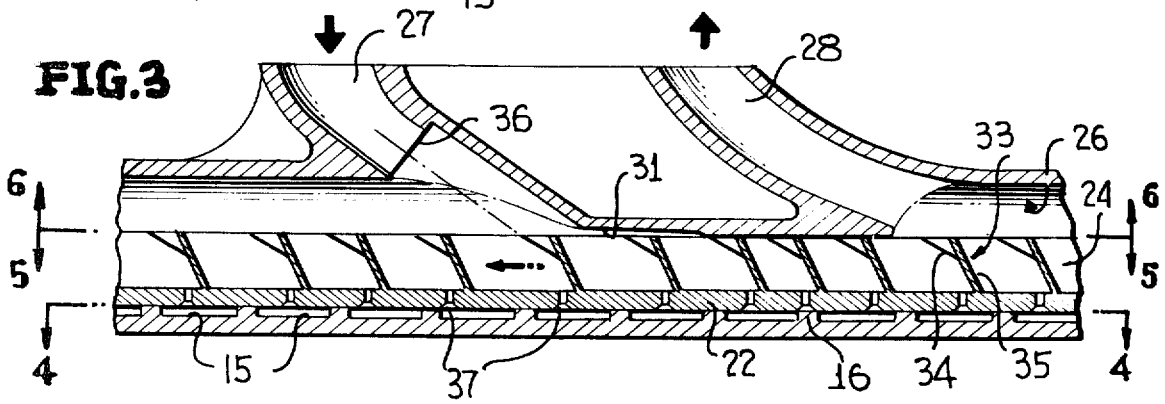
FIG. 3 is an enlarged cross-sectional view taken generally along line 3—3 of FIG. 1, and illustrates inlet and outlet ports along with the different spacing between blades of the compressor wheel.

The blades 33 are disposed generally radially within the channel 25 of the compressor wheel 18, and each blade 33 includes a radially innermost blade portion 34 (FIG. 7) and a radially outermost portion 35. THe innermost blade portions 34 and the outermost blade portions 35 are inclined relative to the axis of rotation 17 of the compressor wheel 18, in the manner best illustrated in FIG. 8 of the drawings. The blade portions 34, 35 of each blade 33 are also inclined in the direction of fluid flow along the chamber 26 which, as viewed in FIG. 3, is from right-to-left. The angle A1 of the outermost blade portion 35 or the angle of attack A1 thereof is depicted in FIG. 8 and is less than the angle A2 thereof which represents the inside angle of attack or the angle of the innermost blade portion 34 to a plane parallel to the axis 17 of rotation of the compressor wheel 18. This difference in the angles of the innermost and outermost blade portions to a plane normal to the axis of rotation 17 of the compressor wheel 18 achieves optimum flow conditions of fluid through the chamber 26 during the rotation of the compressor wheel 18 to conduct fluid from the inlet port 27 through the chamber 26 and outwardly therefrom through the outlet port 28.

During the rotation of the compressor wheel 18 a circular eddy of fluid, be it a gaseous or liquid medium, is produced in the manner indicated by the unnumbered headed arrows shown in FIG. 1. This circular eddy or current must enter the gaps (unnumbered) between the blades in a smooth fashion and is achieved both by the proper shaping of the blades 33 and the inlet angle of the inlet port 27 which is preferably no more than 45°, although it may be less, and this angular relationship is best shown in FIG. 3. The same smooth current is also achieved when the outside angle of attack A1 is smaller than the inside angle of attack A2 with the inside angle of attack being preferably equal to or larger than 45°. Depending, of course, upon the selected operational revolutions per minute the optimum angles of the blade portions or angles of attack thereof are different, such that with increasing revolutions per minute of the compressor wheel 18 the outside angles of attack A2 become smaller, possibly even negative, and the inside angles of attack A1 become larger. In the case that a non-smooth or interrupted operation is preferred in favor of a less expensive production one can select in an extreme case even flat blades with an angle of attack which corresponds to the calculated inside and outside angles of attack for the particular revolutions per minute in question.

In the case of high speed compressors with a flow velocity of approximately 200 meters/second and a peripheral speed of 70 m/s, the outside angles of attack of 0°–30° and inside angles of attack of 50°–70° have proven to be the optimum angles. For slow speed compressors with a flow velocity of 100 m/s and a peripheral speed of about 40 m/s the corresponding angles would be 15°–45° and 45°–60° respectively.

The inlet port 27 also terminates in an inlet aperture 36 (FIG. 3) spaced remotely from and above the uppermost edges (unnumbered) of the blades 35 as a result of which a greater exchange of impulses are created between the chamber 26 and the compressor wheel 3 during rotation of the latter.

In order to avoid excessive axial forces acting upon the bearings of the rotor caused by pressure build-up in the chambers formed by the housing portion 11, the blades 33 and the compressor wheel 18, apertures 37 are formed in the bottom portion 22 of the compressor wheel 18. The apertures 37 lie between each pair of blades 33 and connect the chambers of the compressor with the recesses 15 causing a balance of pressure on both sides of the compressor wheel 18.

Experiences have proven that a strong high frequency noise can result in compressors of this type, and in order to avoid this provision has been made in several ways, such as arranging the blades 35 into groups of blades, such as indicated by the segments 38, 39 and 40 of FIG. 9. The blades within the segment 38 occupy an angle of approximately 47 degrees and the blade spacing between blades is 6, 7, 8, 8, 9 and 9 degrees. Likewise, the segment 39 has a plurality of blades spaced 6, 7, 7, 8, 8, 9, 9, 9, degrees whereas the segment 40 between 110° and 180° has a plurality of blades spaced from each other 6, 7, 7, 7, 8, 8, 9, 9, 9 degrees. Thus there are three groups of blades one within each of the segments 38, 39 and 40 which are distributed in a non-divisible fashion among themselves with the spacing of the blades within each blade group being also varied by increasing the blade spacing within each group 38 through 40 oppositely to the direction of rotation of the wheel, as is indicated by the unnumbered headed arrow in FIG. 9. As a result of this blade spacing and grouping the building up of resonance vibration is largely avoided.

Though only three groupsing of blades are shown in FIG. 9 by the segments 38, 39 and 40, it is to be appreciated that each segment has a like segment diametrically opposite thereto between the angles 180–227, 227–290 and 290–360. Experiences have shown that a side channel compressor of the construction according to this invention has a high degree of effectiveness and is superior to heretofore known side channel compressors.

Although only a preferred embodiment of the compressor 10 has been specifically illustrated and described, it is to be understood that minor variations may be made in the compressor without departing from the spirit and scope of the invention as defined by depended claims.

I claim:

1. A side channel compressor comprising a housing defining a fluid conveying chamber, said fluid conveying chamber being of a curved configuration, a compressor wheel, means mounting said compressor wheel for rotation about an axis, fluid inlet and fluid outlet ports in fluid communication with said fluid conveying chamber, said compressor wheel having a plurality of blades which during the rotation of said compressor wheel move fluid along said chamber in a direction from said inlet port toward said outlet port, each blade being disposed generally radially relative to said axis, each blade having a radially innermost and outermost blade axially extending surface portions with the latter being more remote from said axis than the former, said innermost and outermost blade portions being inclined relative to said axis and inclined in the direction of fluid flow along said chamber, and the angle of said innermost blade axially extending surface portions to a radial plane being steeper in the opposite direction of rotation of said compressor wheel than the angle of said outer most blade axially extending surface portions to said same direction of rotation where by optimum flow conditions of fluid through said chamber are achieved.

2. The side channel compressor as defined in claim 1 wherein the angle of said outermost blade axially extending surface portions range generally between 0°–45°.

3. The side channel compressor as defined in claim 1 wherein the angle of said innermost blade axially extending surface portions range between 35°–75°.

4. The side channel compressor as defined in claim 1 wherein said inlet port opens into said fluid conveying chamber in a direction opposing the direction of rotation of said compressor wheel.

5. The side channel compressor as defined in claim 1 wherein the angle of said outermost blade axially extending surface portions range generally between 0°–45°, and wherein the angle of said innermost blade axially extending surface portions range between 35°–75°.

6. The side channel compressor as defined in claim 1 wherein said inlet port opens into said fluid conveying chamber in a direction opposing the direction of rotation of said compressor wheel and at an angle of generally 45° to a plane normal to said axis.

7. The side channel compressor as defined in claim 1 wherein said blades are distributed about said compressor wheel non-uniformly in such a way that different groups of blades are distributed over different sector angles non-divisible among one another, and the distribution of the blades is varied within the groups of blades.

8. The side channel compressor as defined in claim 1 wherein said blades are distributed about said compressor wheel non-uniformly in such a way that different groups of blades are distributed over different sector angles non-divisible among one another, and the distribution of the blades is varied within the groups of blades, the distribution of the blades is varied within the groups of blades, and the distribution of said blades within the groups is such that the spacing between adjacent blades increases in a direction opposite to the direction of rotation of said compressor wheel.

9. The side channel compressor as defined in claim 1 wherein said blades are distributed about said compressor wheel such that the spacing of a plurality of the blades increases in a direction opposite to the direction of rotation of said compressor wheel.

10. The side channel compressor as defined in claim 1 including surface means between said inlet and outlet ports for separating the same from each other, recess means in said surface means immediately adjacent said inlet port, and said recess means has a length, as measured in the direction of compressor wheel rotation, at least as great as the maximum spacing between any two of said blades.

11. The side channel compressor as defined in claim 10 wherein said recess means is tapered and increases in size in the direction of compressor wheel rotation.

12. The side channel compressor as defined in claim 1 wherein said compressor wheel includes an inner and an outer peripheral wall and a wall spanning therebetween, said last mentioned wall defining an annular chamber within which are housed said blades, apertures in said spanning wall opening one each into spaces between selected pairs of said blades, and recess in said housing spaced from each other and aligned for passage thereover of said apertures upon the rotation of said compressor wheel.

* * * * *